United States Patent [19]

Schultes et al.

[11] Patent Number: 4,682,617

[45] Date of Patent: Jul. 28, 1987

[54] SHORTENABLE UMBRELLA HAVING A TELESCOPIC STICK

[75] Inventors: Tilmann Schultes, Solingen; Klaus Stiller, Langenfeld, both of Fed. Rep. of Germany

[73] Assignee: Kortenbach Verwaltungs- und Beteiligungsgesellschaft mbH & Co., Solingen, Fed. Rep. of Germany

[21] Appl. No.: 903,194

[22] Filed: Sep. 3, 1986

[30] Foreign Application Priority Data

Sep. 7, 1985 [DE] Fed. Rep. of Germany ..... 3531951

[51] Int. Cl.[4] ..... A45B 25/14

[52] U.S. Cl. ..... 135/38; 135/22; 135/25 R

[58] Field of Search ..... 135/38, 22, 23, 24, 135/25, 20

[56] References Cited

U.S. PATENT DOCUMENTS

| | | | |
|---|---|---|---|
| 257,872 | 5/1882 | Iehl | 135/38 |
| 1,902,363 | 3/1933 | Haupt | 135/22 |
| 1,991,385 | 2/1935 | Geisel | 135/22 X |
| 2,725,888 | 12/1955 | Haupt | 135/38 |
| 4,418,707 | 12/1983 | Wu | 135/24 |
| 4,573,487 | 3/1986 | Schultes | 135/24 |

FOREIGN PATENT DOCUMENTS

| | | | |
|---|---|---|---|
| 126445 | 1/1932 | Austria | 135/22 |
| 654150 | 12/1962 | Canada | 135/38 |
| 976122 | 3/1963 | Fed. Rep. of Germany . | |
| 2852998 | 6/1980 | Fed. Rep. of Germany | 135/24 |
| 504324 | 12/1954 | Italy | 135/38 |
| 95549 | 2/1960 | Norway | 135/24 |
| 6436 | of 1904 | United Kingdom | 135/24 |

*Primary Examiner*—J. Karl Bell

*Attorney, Agent, or Firm*—Samuel Meerkreebs

[57] ABSTRACT

A shortenable umbrella having a telescopic stick, two lowermost parts (2a,2b) of which are latched in their extended position by a spring hook (20). The latch is overridden by the final downward movement of a slider (8) upon bundling the framework and canopy around, and compressing them towards, the stick, whereby the slider is received within a hollow handle (1).

9 Claims, 9 Drawing Figures

SHORTENABLE UMBRELLA HAVING A TELESCOPIC STICK

The invention concerns a shortenable umbrella (hereinafter referred to as of the kind described) having a telescopic stick; a crown fixed to one end of the stick; a hollow handle fixed to the other end of the stick; and a slider which is slidable on the stick upon opening and closing of a canopy framework comprising spokes and struts hinged to and carried by the crown and slider; the hollow handle, which is fixed to a lowermost part of the stick receiving the slider and a release actuator therefor upon shortening of the stick when the framework is closed and after release of a latch for latching the lowermost stick part to a next lowermost stick part in a mutually extended position.

Depending on the detailed construction, there may be one or two sliders on the stick; and there may be an opening-spring loaded between two sliders and/or if necessary also one or more driving springs loaded between the telescopic parts of the stick.

An umbrella is already known, for example, from U.S. Pat. No. 2,725,888 wherein, upon sliding the lowermost part of the stick of a telescopic umbrella stick into the next lowermost stick part, the handle in the form of a hollow sleve connected to the lowermost part of the stick is slid over the slider in the closed state in such a way that the slider is surrounded. This enclosing of the slider and its release actuator during the course of the telescopic shortening of the stick enables, besides the shortening of the stick, any actuation of the slider to be prevented in the closed shortened state of the umbrella. In particular with mechanisms for automatic opening of the stick and/or the canopy, this avoids any risk of release by mistake. In order to bring the slider and its release actuator into the position ready for operation, the lowermost part of the stick has first to be pulled out again and the slider as well as its release actuator exposed for handling. This manipulation is in itself quite practicable and of great utility for any shortenable umbrella, in particular those of self-opening construction, but nevertheless it leaves a certain doubt in the operational necessity which still has finally to be attended to at the end of the shortening of the umbrella and the overlapping of the slider and its release actuator, of bundling the set of canopy spokes together with the canopy cover, which because of certain unavoidable inherent stresses in the whole umbrella mechanism are still permanently spread out loosely a little way away from the umbrella stick, carefully and neatly in parallel with the stick and ready for insertion into its sheath. So of course in the practical use of such umbrellas it has proved that many umbrella users, after the shortening and the aforesaid sliding over of the handle, already put the umbrella away in this state without performing the still necessary final bundling of the canopy.

The object of the invention is to create an umbrella of the kind described, which in the closed and shortened state enables not only an inaccessibly covered overlap of the handle over the slider and its release actuator, but furthermore also in this state an already quite ready orderly and careful bundling and folding of the set of canopy spokes and, in use, of the canopy cover in contact with the umbrella stick, where for this additional function there is in particular also to be necessary no significant additional outlay in parts or sigificant additional operating procedure.

This problem is solved in accordance with the invention if the latch is released by final sliding of the slider down the stick when, in the course of final closing of the framework and, in use, a canopy supported by the framework, are manually bundled around, and compressed towards, the stick.

A shortenable umbrella is thereby created in which, during the course of the shortening, not only is the slider and its release actuator secured so as to be inaccessible through the sliding of the handle over them, but in addition the umbrella canopy is also resting against the umbrella stick, bundled and folded in parallel with the stick and ready for its sheath. This is effected as a result of the regular habit practised by the user in shortening the closed umbrella of grasping it first of all in one hand. Because of the radial pressing together of the umbrella canopy, the residual spread in the set of spokes of the umbrella which still remains after the closing of the umbrella through various inherent stress influence is eliminated, and the set of spokes is stretched in the direction of the handle, with the result of a certain residual shifting of the slider or sliders towards the handle. This habit and the actions consequent upon it is made use of by the invention without any additional outlay, for releasing the latch for the shortening of the stick and the overlapping of the handle over the slider and its release actuator, by the slider in its aforesaid residual sliding encountering the latch for the pulling out of the stick and handle and tripping it out of its latched position with respect to the slider as well as also out of its latch engagement with the lowermost and next lowermost stick parts. By the sliding of the lowermost part of the stick into the next lowermost stick part, and the simultaneous overlapping of the handle over the slider and its release actuator, the aforesaid bundling and folding of the umbrella canopy in parallel with the stick is at the same time established.

A particularly simple construction results if the latch comprises a springy latching-hook, which is fixed in the lowermost stick part and has a latching nose, which, in the mutually extended position of the lowermost and next lowermost stick parts, engages through latch openings in both these stick parts, the latching nose being disengaged to release the latch by contact with a guide sleeve on the slider, during the final closing movement.

The handle may have a grip sleeve portion fixed to the lowermost stick part and a slidable portion, which is fixed to, and moves with, the next lowermost stick part, and which carries a spring-loaded latching bolt having a ring part, which surrounds a guide sleeve of the slider in the closed position and engages in a notch in the guide sleeve to latch the slider in the handle, the bolt also having a button by which the bolt may be slid transversely to the stick axis against the spring loading to release the slider; the slidable portion of the handle being received in a cavity of similar contour in, and surrounded by, the grip sleeve portion upon mutual shortening of the lowermost and next lowermost stick parts.

An easier arrangement and accommodation of the bolt remains if the slidable handle portion consists of two parts which are detachably connected together and which define between them a guide channel for the latching bolt.

An easier cooperation between the slider and the handle is possible if the handle has a funnel-shaped entry for the slider.

The pull-out mechanism for the stick may be refined in a particularly simple way in connection with a three-part telescopic stick if the next lowermost stick part is slidable telescopically into a third part of the stick having, at its lower end a portion of reduced width which prevents separation of these stick parts, the next lowermost and third stick parts being associated with two catches, of which a first catch secures these stick parts together in their mutually shortened position and is overridden by the slider moving in the opening direction, whilst the other catch secures these stick parts in their mutually extended position and is overridden by the slider moving in the closing direction.

The two catches on the telescopic stick may consist of a common spring stirrup fixed in the next lowermost stick part and having two locking noses.

The lowermost stick part together with the handle may be securable by means of a frictionally acting catch in the mutually retracted position of the lowermost and next lowermost stick parts.

The cooperation between the slider and the latch which latches the lowermost and next lowermost stick parts is rendered reliable, in spite of manufacturing tolerances between the parts if, in the handle between the slider and the latch, a ring, which is spring urged against the slider and is slidable on the stick, is arranged to transmit the final sliding movement of the slider to the latch to release the latch.

The invention is explained in greater detail by way of three examples with reference to the accompanying drawings, in which.

Figures 1, 2:
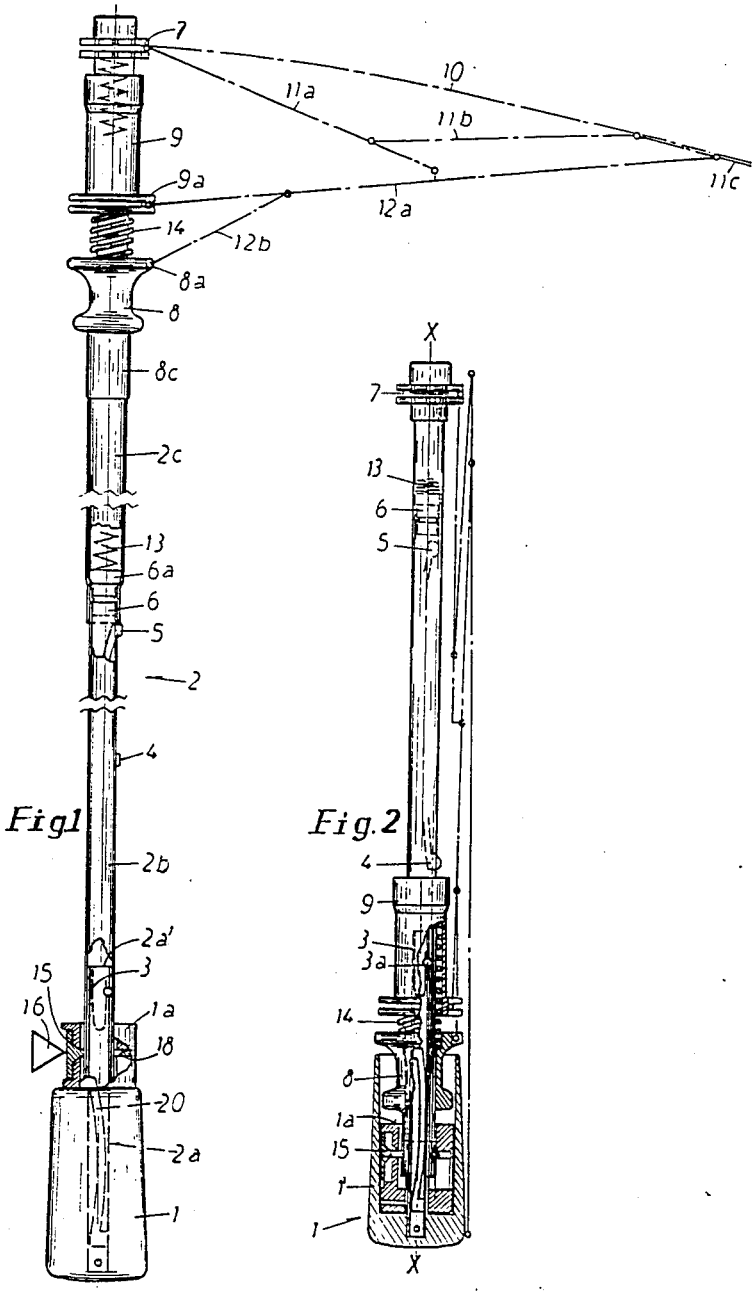
FIG. 1 is a diagrammatic side view of an umbrella having an automatically opening construction, in the opened state.
FIG. 2 is a view corresponding to FIG. 1, but partially sectioned, and with the umbrella in the closed state.
Figure 3:
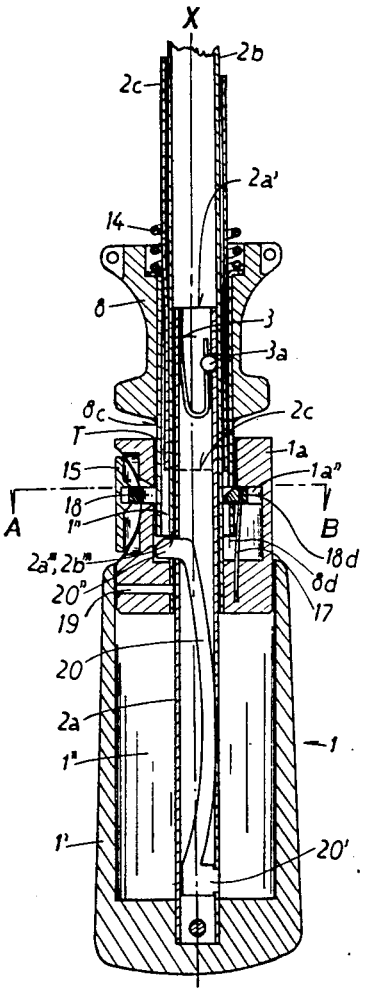
FIG. 3 is an axial section through the bottom part of the umbrella.

The invention is exemplified by a shortenable umbrella of the self-opening construction, but it is also applicable to a construction which is to be opened and closed manually.

The illustrated umbrella has a handle 1 at the bottom end of a telescopically shortenable stick 2. The handle 1 is fixed to a bottom member of the stick, i.e. to a piece of tube 2*a* forming a lowermost stick part, which is received in a piece of tube 2*b* forming a next lowermost stick part, which in turn is received in a piece of tube 2*c*. The pieces of tube 2*a*, 2*b* and 2*c* of the stick may be received in one another so as to be secure against relative turning by means of hexagonal cross-sections (FIG. 4) or, in the case of a round cross-section, by means of longitudinal guide grooves, and in their pulled-out and/or pushed-together positions are secured with respect to one another by catches 3, 4 and 5. The catch 3 secures the piece of tube 2*a* in the pushed-in position in the piece of tube 2*b*, the catch 4 secures the piece of tube 2*b* in the piece of tube 2*c* in the pushed-in position and the catch 5 secures the piece of tube 2*c* in the pushed-out position to the piece of tube 2*b*. A plug 6 seated at the top end of the piece of tube 2*b* has an annular shoulder 6*a* so that the pieces of tube 2*b*, 2*c* cannot be separated from one another. The piece of tube 2*a* ends at an edge 2*a*′ in the piece of tube 2*b* and the piece of tube 2*c* reaches at its bottom edge 2*c*′ into the handle 1 in the closed position. At the top end of the piece of tube 2*c* is seated a crown 7. Onto the latter as well as onto crowns 8*a* and 9*a* of two sliders 8 and 9, which are able to slide up and down the stick 2, are hinged in a star-shaped arrangement, a ring of canopy spokes 11*a*, 11*b*, 11*c* supporting a fabric canopy 10 and their struts 12*a*, 12*b*, the spokes and struts forming a framework.

Figure 4:
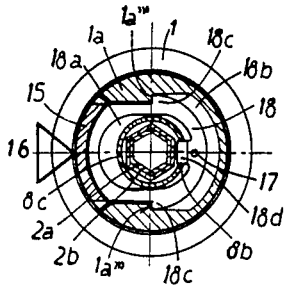
FIG. 4 is a section taken on the line A—B in FIG. 3.

Kinematically, this framework is automatically opened, and at the same time the stick 2 is automatically telescoped out, by a compression spring 13, which is stressed between the crown 7 and the piece of tube 2*b* and tries to force the pieces of tube 2*b* and 2*c* apart, and by the sliders 8, 9, which are loaded against one another by a further compression spring 14 and thus have the tendency to be forced upwards as soon as a release button 15 is pressed in transversely, i.e. radially, to the axis X of the stick in the direction of the arrow 16 (FIGS. 1, 4). The release button 15 is a finger- or thumb-actuated part of a bolt 18 of a mechanism for the latching and release of the slider 8 in the closed position of the umbrella canopy (FIGS. 2–5). The bolt 18 is supported so as to be able to slide transversely to the axis X of the stick against the action of a spring 17 inside a portion 1*a* of the handle 1.

The bolt 18 has a ring part with an oval opening 18*a* surrounding a guide sleeve 8*c* of the slider 8 as well as the pieces of tube 2*a* and 2*b*, with a corresponding clearance near the release button 15, the bolt sliding in a bearing in a slide channel 1*a*″ in the portion 1*a*. The slide channel 1*a*″ has a clearance 18*b* corresponding to the clearance in the oval 18*a*, as well as stop corners 1*a*‴ for engaging stop edges 18*c* on the bolt 18 (FIG. 4). In this way a latching nose 18*d* of the bolt 18 engages, under the action of the spring 17, in a latch opening or notch 8*b* in the guide shank 8*c* of the slider 8 in the closed position of the umbrella canopy in readiness for release of this latch mechanism, and may be slid by means of the release button 18, against the spring action in the direction of the arrow 16 and thereby disengaged out of the latch opening 8*b* in the slider 8, with the result that the slider 8 and the slider 9 are released and, under the action of the spring 14, move upwards along the stick 2 in the opening direction. In doing so the sliders 8, 9 slide over the stick catch 4 so that it gets pressed in sufficiently for the two pieces of tube 2*b* and 2*c* to be freed for telescoping apart under the action of the spring 13.

The portion 1*a* of the handle 1 supporting the bolt 18 is fixed to the piece of tube 2*b* by a pin 19 and is thereby connected to the piece of tube 2*b* so as to move with it. The bottom part of the handle 1 has a cavity 1″ conforming to the contour of the portion 1*a* and forms a grip sleeve 1′, in which the lower end of the piece of tube 2*a* is fixed, and which, upon the sliding of the piece of tube 2*a* into the piece of tube 2*b* in the direction of an additional shortening of the umbrella stick, may be pushed over the portion 1*a* as well as over the slider 8 as shown in FIG. 2. With this telescopic handle arrangement is associated a springy latching hook 20, which is fixed in the piece of tube 2*a*, and secures the portion 1*a* against separation from the grip sleeve 1', irrespective of the pulled-out position of the piece of tube 2*a* from the piece of tube 2*b*. The arrangement of this mechanism is only possible because, for the arrangement and construction of the mechanism 15–18 for the latching and release of the slider 8, no space or corresponding deformations are necessary in the stick 2. Consequently instead of the telescopic handle arrangement, or instead of the latch 20 one might obviously, for example, also build a spring element for the telescoping of the pieces of tube 2*a*, 2*b* into the aforesaid free space.

The latching hook 20 is fixed into the piece of tube 2*a* by means of a claw 20' and, after the umbrella has been closed by pulling down the slider 8 by hand, with consequent latching by the catch 4 of the two pieces of tube 2*b*, 2*c* loaded against one another by the spring 13, without any outlay upon additional components, that is, by the means already available as well as without the observance of any extraordinary conditions of operation, the hook is released to allow additional shortening of the umbrella. Unintentional actuation of the release button 15 and opening of the umbrella, is also avoided as the grip sleeve 1' is slid over and covers the button and the portion 1*a* as well as the slider 8, as shown in FIG. 2.

Figure 5:
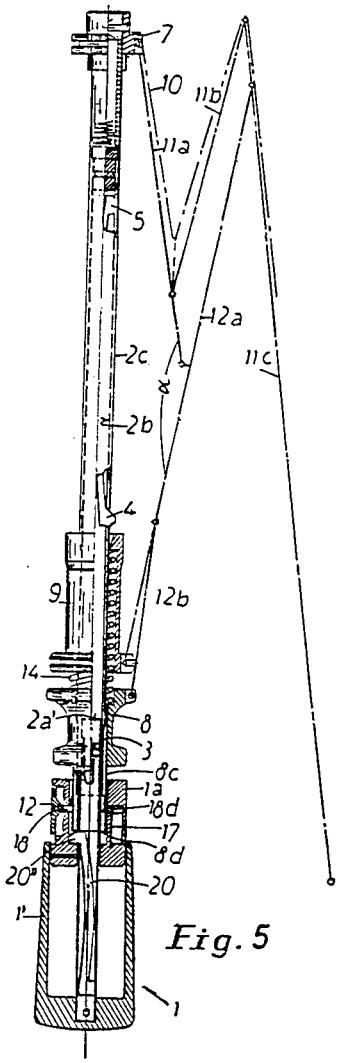
FIG. 5 is a view corresponding to FIG. 2, but with umbrella in the nearly closed state.
Figure 6:
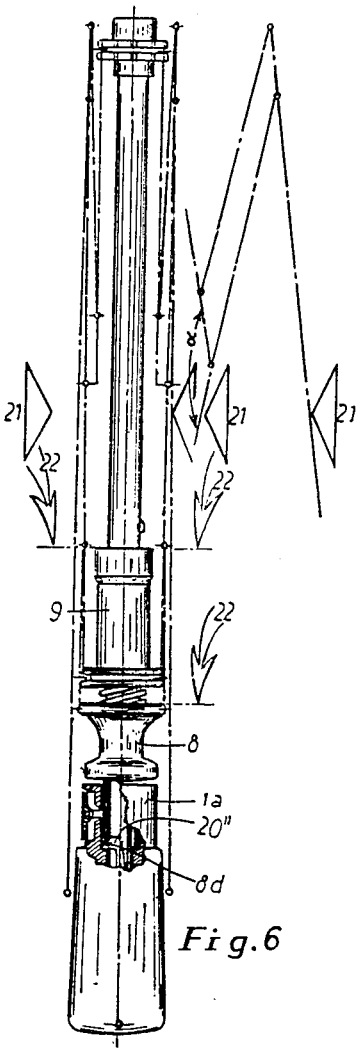
FIG. 6 is a view corresponding to FIG. 5, but in the fully closed state.

The set of canopy spokes, and their struts, because of their unavoidable compressive and tensile stresses do not exactly, upon closing the umbrella become nicely bundled against the stick 2, parallel to the stick, and resting appropriately against it, but retain a certain residual spread away from the stick 2 at, say, at an angle of kink (FIGS. 5, 6). The user of the umbrella for his part eliminates this residual spread uniformly without any special observance of an instruction, by clasping the set of canopy spokes with the folded canopy 10 and pressing them together so that a bundling and folding of the umbrella in parallel with the stick, ready to go in its sheath, comes about. In the course of this uniform bundling by hand the set of canopy spokes, with the canopy 10, get pressed together towards the axis X of the stick in the direction of the arrow 21 (FIG. 6) to run in parallel with the stick 2, with accompanying increase in the residual angle of kink and in compensation gets stretched or elongated a little in the direction of the handle 1 i.e. in the direction of the arrow 22. The sliders 8 and 9 connected to the set of canopy spokes carry out this stretching or elongation with them, with the result that the slider 8 lying with the end 8*d* of its guide sleeve 8*c* in front of a latching nose 20'' rides over latching nose 20'' and forces the latter so far into the piece of tube 2*a* that the latching nose 20'', upon pushing the grip sleeve 1' upwards, no longer engages in the latch openings 2*a'''*, 2*b'''* in the pieces of tube 2*a*, 2*b* so as to lock them, but with the aforesaid upwards push slides during the nesting of the piece of tube 2*a* in the piece of tube 2*b* inertly against the inner wall of the latter until a ball 3*a* of the catch 3 drops into a notch in the piece of tube 2*b* and the nesting of the piece of tube 2*b* ends up in a position corresponding with that shown in FIG. 2. As may further be seen from that, through the sliding of the grip sleeve 1' over the parts 1*a* and 8, the release button 15 is completely enclosed, i.e. concealed from any contact, and in this way release of the umbrella by mistake is quite impossible. This is possible again only when the grip sleeve 1' is pulled downwards again during the course of elongation of the stick. In doing so the piece of tube 2*a*, together with the latching hook 20, get pulled out of the piece of tube 2*b* until its latching nose 20'' again snaps through the latch openings 2*a'''*, 2*b'''* and thus the pieces of tube 2*a* and 2*b* pulled out with respect to one another get latched together and at the time the slider 8 and the portion 1*a* of the handle with the release button 15 become exposed again ready for release, corresponding with the position shown in FIGS. 1 and 3 to 6.

The mechanism described above for the latching and release of the slider 8 in the closed position of the umbrella is thus a mechanism which, without any involvement of space for arrangement or refinements in or on the stick 2, is realised through a direct latching and release between the handle 1 and the slider 8. The handle 1, or the portion 1*a* of the handle, may furthermore consist of two separate parts, namely a bottom part and a top part, the two parts may be designed that they are connected together by means, for example, of snap noses or edges or other suitable detachable means of connection, in order in that way to be able to define between them the slide channel 1*a''* and to mount the bolt 18 and the spring 17 so as to be easily accessible.

In order that the slider 8, during the course of the closing and folding together of the umbrella out of the open state of the umbrella in accordance with FIG. 1, may run with less friction of the guide sleeve 8*c* into the portion of handle 1*a*, the annular channel 1''' in this portion of handle, which receives the guide sleeve 8*c*, may be provided with a funnel-shaped entry T.

Figure 7:
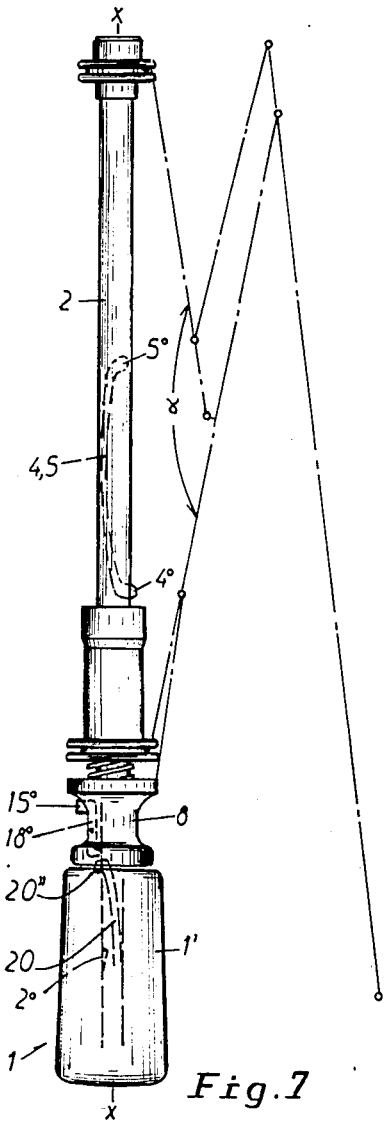
FIG. 7 is a diagrammatic side view of a second example of umbrella, shown in the nearly closed state.
Figure 8:
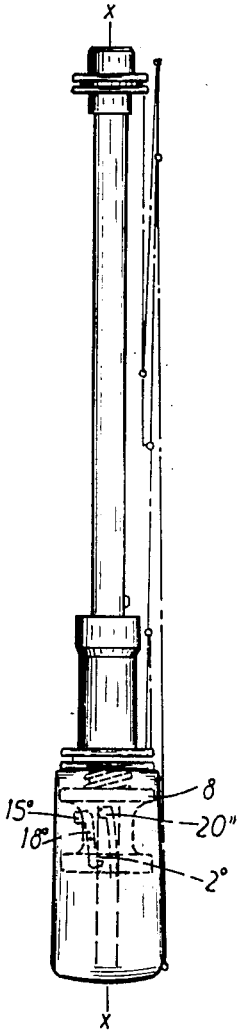
FIG. 8 is a view corresponding to FIG. 7, but in the fully closed state; and, FIG. 9 is a partly sectional side view of a bottom part of a third example.

In the case of the modification illustrated in FIGS. 7 and 8, the same reference numbers are used, insofar as they relate to parts identical with those of the previously described example. In this example the latch which latches the slider 8 is not a bolt 18 arranged on the handle 1 and with a ring part, but a latching lever 18° provided with a release button 15° and engaging in a latch slit 2° in the piece 2*a* of the tube. The slider 8 and the release button 15° are likewise covered over by the hollow handle 1 in the way previously described, upon sliding the piece 2*a* of tube into the piece 2*b* of tube as soon as the latching hook 20, which latches the two pieces 2*a*, 2*b* of tube by its locking nose 20'', is overridden by the slider 8 or its locking lever 18° moving against it from above, that is again because of the residual stroke of the slider 8 effected in the direction towards the handle 1 during the course of the bundling and stretching of the set of canopy spokes as already described, out of the residual angle of kink $\alpha$ towards the stick 2.

As may further be seen from FIGS. 7 and 8, the two catches 4 and 5 for the locking of the stick may advantageously be made also in one piece in the form of a spring stirrup having two locking noses 4° and 5° acting independently of one another and respectively overridden upon movement of the slider up or down the stick.

Figure 9:
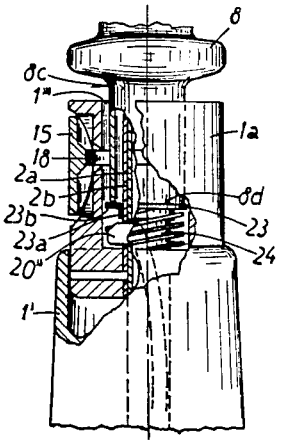

FIG. 9 shows a mechanism in the form of a ring-shaped release adaptor for the latch in the form of the latching hook 20 which latches the two pieces 2*a*, 2*b* of tube and the handle 1 in the extended state. This adaptor is particularly suitable for bridging dimensional tolerances between the slider 8, the stick 2 and the locking-hook 20 and has a ring 23 which slides inside the handle 1 by a collar 23*a* on the stick 2. A flange 23*b* stands out radially from the collar, and under the action of a compression spring 24, rests hard up against the guide sleeve 8c of the slider. The compression spring, at its other end preferably bears against the bottom of the guide channel 1‴, and the ring 23 may be prevented from turning by a polygonal cross-sectional profile or by corresponding guide grooves on the stick 2. Through this adaptor it may be ensured that any residual stroke of the slider 8, upon of the described bundling and stretching of the set of canopy spokes, is transmitted through the collar 23a which overrides the nose 20″ of the latching-hook 20, however large the tolerances in the cross-section of the slider 8 and of the stick 2, that is, for example, in the guidance of these parts by one another. Thereby the necessary action upon the latching nose 20″ of the latching-hook 20, is reliably achieved.

We claim:

1. A shortenable umbrella having a telescopic stick comprising at least lowermost and next lowermost stick parts and a latch for latching said stick parts in a mutually extended position; a crown fixed to one end of said stick; a hollow handle fixed to said lowermost stick part; a slider having a release actuator therefor and being slidable on said stick; and a framework adapted to support a canopy and comprising spokes and struts hinged to and carried by said crown and slider; said hollow handle receiving said slider and release actuator upon shortening of said stick when said framework is closed and after release of said latch; wherein said latch is releasable by final sliding of said slider along said stick towards said handle when, in the course of final closing of said framework and, in use, a canopy supported thereby, are manually bundled around, and compressed towards, said stick.

2. An umbrella according to claim 1, wherein said slider has a guide sleeve and said latch comprises a springy latching-hook fixed in said lowermost stick part and having a latching nose, said lowermost and next lowermost stick parts each having latch openings adapted to receive said latching nose in a mutually extended position of said stick parts, said latching nose being adapted to be disengaged to release said latch by contact with said guide sleeve.

3. An umbrella according to claim 1, wherein said slider has a guide sleeve formed with a notch and said handle comprises relatively slidable first and second portions, said first handle portion being fixed to said next lowermost stick part and carrying a spring-loaded latching bolt having a button part, and said second handle portion being fixed to said lowermost stick part and forming a grip sleeve with a cavity conforming to the contour of said first handle portion; said latching bolt having a ring part surrounding said guide sleeve and engageable with said notch to latch said slider in said handle, said bolt being slidable transversely to the axis of said stick against said spring-loading upon pressing said button part to release said slider, and said first handle portion being slidably received in said cavity in, and surrounded by, said second handle portion upon mutual shortening of said lowermost and next lowermost stick parts.

4. An umbrella according to claim 1, wherein said handle has a funnel-shaped entry for said slider.

5. An umbrella according to claim 1, wherein said first handle portion consists of two detachably connected parts defining therebetween a guide channel for said latching bolt.

6. An umbrella according to claim 1, wherein said next lowermost stick part is slidable telescopically into a third stick part having at an end thereof a portion of reduced width preventing separation of said next lowermost and said third stick parts, said next lowermost and said third stick parts being associated with first and second catches, said first catch securing said stick parts together in a mutually shortened position and being adapted to be overridden by said slider moving in a direction to open said framework, and said second catch securing said stick parts together in a mutually extended position and being adapted to be overridden by said slider moving in a direction to close said framework.

7. An umbrella according to claim 6, wherein said first and second catches consist of two noses on a common spring stirrup fixed in said next lowermost stick part.

8. An umbrella according to claim 1, wherein said lowermost stick part together with said handle is securable by means of a frictionally acting catch in the mutually retracted position of said lowermost and next lowermost stick parts.

9. An umbrella according to claim 1, further comprising a ring slidable on said stick between said slider and said latch and adapted to transmit said final sliding movement of said slider to said latch to release said latch; and spring means urging said ring against said slider.

* * * * *